United States Patent [19]

Hague, Sr. et al.

[11] Patent Number: 4,892,192

[45] Date of Patent: Jan. 9, 1990

[54] COUPON ORGANIZER

[76] Inventors: Timothy J. Hague, Sr.; Linda E. Hauge, both of 18 Rose Ave., Gibbstown, N.J. 08027

[21] Appl. No.: 306,635

[22] Filed: Feb. 6, 1989

[51] Int. Cl.[4] ..... B65D 85/00

[52] U.S. Cl. ..... 206/425; 206/831; 206/232; 220/17

[58] Field of Search ..... 206/223, 425, 831, 232; 220/17

[56] References Cited

U.S. PATENT DOCUMENTS

| | | | |
|---|---|---|---|
| 4,260,055 | 4/1981 | Slaybaugh | 206/425 |
| 4,577,547 | 2/1986 | Phillips | 206/459 |
| 4,676,372 | 6/1987 | Rager | 206/425 |
| 4,684,019 | 8/1987 | Egly | 206/425 |
| 4,802,575 | 2/1989 | Martin | 206/425 |

*Primary Examiner*—Joseph Man-Fu Moy
*Attorney, Agent, or Firm*—Jerry T. Kearns

[57] ABSTRACT

A coupon organizer for organizing and transporting coupons to a grocery store is formed from a box-shaped rectangular housing having a hinged cover. A latch mechanism is provided for securing the cover in a closed position and a carrying handle is mounted on an upper exterior surface of the cover. A plurality of spaced hook and loop fastening members on an interior surface of the cover removably secure various coupon accessory items including folding scissors, note pads, a writing instrument and a calculator. In a second embodiment of the invention, a retractable waste receptacle is pivotally mounted on an exterior surface of the housing and is secured in an operative position by a pivotal thumb latch.

3 Claims, 3 Drawing Sheets

COUPON ORGANIZER

BACKGROUND OF THE INVENTION

1. Field of the Invention

The present invention relates to coupon organizers, and more particularly pertains to a new and improved coupon organizer for organizing and transporting coupons and coupon clipping accessory items in a single integrated easily transportable carrier. A wide variety of marketing coupons are published in newspapers and magazines which enable alert individuals to save a substantial sum of money on groceries and other items. However, clipping and organizing these coupons is a difficult and cumbersome chore, unless a proper organization device is utilized. In order to enable individuals to conveniently achieve maximum coupon savings, the present invention provides an integral easily transportable carrier for housing and alphabetizing coupons and for conveniently storing coupon and shopping accessories.

2. Description of the Prior Art

Various types of coupon organizers are known in the prior art. A typical example of such a coupon organizer is to be found in U.S. Pat. No. 4,004,690, which issued to N. Giarritta on Jan. 25, 1977. This patent discloses a folder having a plurality of individual pockets for cataloguing and storing grocery coupons in various food categories. U.S. Pat. No. 4,312,393, which issued to R. Green on Jan. 26, 1982, discloses a book-like coupon organizer for carrying and arranging various types and size of coupons and refund offers, by designated product categories. The organizer includes front and back panels which are hingedly connected and a plurality of coupon receiving pockets on the inner surface of the panels. The panels are formed of rigid members arranged in spaced edge to edge relation in heat sealable inner and outer plastic sheets. U.S. Pat. No. 4,450,994, which issued to C. Holland on May 21, 1984, discloses a coupon organizer formed as a rectangular receptacle having a hinged cover with a carrying handle. The receptacle is adapted to be clamped to the handle of a shopping cart at the upper rear end of the shopping cart basket. The receptacle contains a series of dividers for segregating coupons in accordance with various headings. A separate compartment is provided in the bottom portion of the receptacle for holding various accessory items such as scissors and a writing instrument. U.S. Pat. No. 4,591,054, which issued to C. Blossom on May 27, 1986, discloses a coupon organizer formed from a plurality of miniature sized indexed file folders enclosed in a flexible carrying pouch. U.S. Pat. No. 4,742,911, which issued to R. Manuel on May 10, 1988, discloses a grocery list forming device which includes a receptacle having a hinged cover and a plurality of interior portions provided with fasteners for securing snap on indicators designating needed food items.

While the above mentioned devices are suited for their intended usage, none of these devices disclose a coupon organizer which utilizes a box-shaped rectangular housing having a hinged cover provided on an interior surface with a plurality of spaced hook and loop fastening members for securing coupon and shopping accessory items such as writing instruments, note pads, scissors and a calculator. Additionally, none of the aforesaid prior art devices utilize a rectangular housing having a bottom portion divided into left and right compartments each housing reduced sized hanging folders for alphabetizing store coupons. Inasmuch as the art is relatively crowded with respect to these various types of coupon organizers, it can be appreciated that there is a continuing need for and interest in improvements to such coupon organizers, and in this respect, the present invention addresses this need and interest.

SUMMARY OF THE INVENTION

In view of the foregoing disadvantages inherent in the known types of coupon organizers now present in the prior art, the present invention provides an improved coupon organizer. As such, the general purpose of the present invention, which will be described subsequently in greater detail, is to provide a new and improved coupon organizer which has all the advantages of the prior art coupon organizers and none of the disadvantages.

To attain this, representative embodiments of the concepts of the present invention are illustrated in the drawings and make use of a coupon organizer for organizing and transporting coupons to a grocery store formed from a box-shaped rectangular housing having a hinged cover. A latch mechanism is provided for securing the cover in a closed position and a carrying handle is mounted on an upper exterior surface of the cover. A plurality of spaced hook and loop fastening members on an interior surface of the cover removably secure various coupon accessory items including folding scissors, note pads, a writing instrument and a calculator. In a second embodiment of the invention, a retractable waste receptacle is pivotally mounted on an exterior surface of the housing and is secured in an operative position by a pivotal thumb latch.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved coupon organizer which has all the advantages of the prior art coupon organizers and none of the disadvantages.

It is another object of the present invention to provide a new and improved coupon organizer which may be easily and efficiently manufactured and marketed.

It is a further object of the present invention to provide a new and improved coupon organizer which is of a durable and reliable construction.

An even further object of the present invention is to provide a new and improved coupon organizer which is susceptible of a low cost of manufacture with regard to both materials and labor, and which accordingly is then susceptible of low prices of sale to the consuming public, thereby making such coupon organizers economically available to the buying public.

Still yet another object of the present invention is to provide a new and improved coupon organizer which provides in the apparatuses and methods of the prior art some of the advantages thereof, while simultaneously overcoming some of the disadvantages normally associated therewith.

Still another object of the present invention is to provide a new and improved coupon organizer for enabling individuals to conveniently clip, organize and transport store coupons in a single integral carrier.

Yet another object of the present invention is to provide a new and improved coupon organizer which provides storage for coupon and shopping accessory items on an interior surface of a hinged cover.

Even still another object of the present invention is to provide a new and improved coupon organizer which utilizes a rectangular housing subdivided into left and right compartments with each compartment holding reduced sized hanging folders for alphabetizing store coupons.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
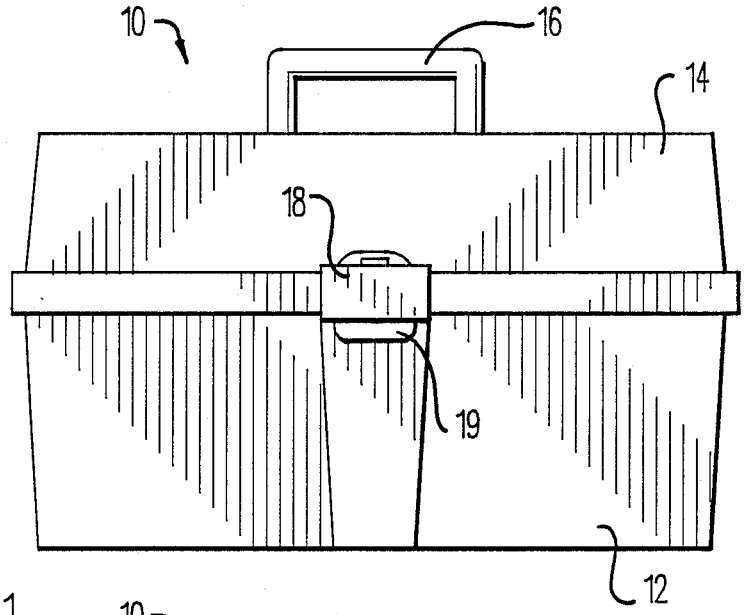
FIG. 1 is a side view of a coupon organizer according to a first embodiment of the present invention, with the hinged cover in a closed and latched position.

With reference now to the drawings, and in particular to FIG. 1 thereof, a new and improved coupon organizer embodying the principles and concepts of the present invention and generally designated by the reference numeral 10 will be described.

More specifically, it will be noted that the first embodiment 10 of the invention includes a box-shaped rectangular housing 12 having a hinged cover for 14. Cooperating latch members 18 and 19 are provided for securing the cover 14 in the illustrated closed position. A carrying handle 16 is centrally mounted on an upper exterior surface of the cover 14.

Figure 2:
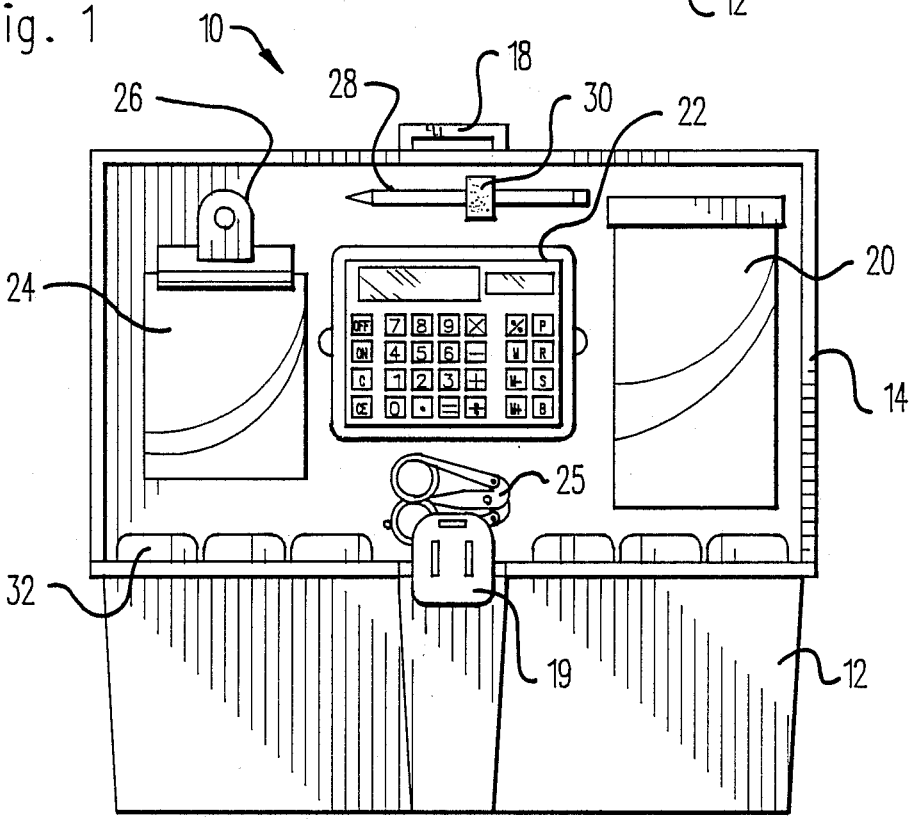
FIG. 2 is a side view of the coupon organizer of FIG. 1, with the hinged cover in an open position.

As shown in FIG. 2, a plurality of spaced hook and loop fastening members, for example 30, are provided on an interior surface of the lid 14 for removably mounting various accessory items including a note pad 20, a calculator 22, a spring clip 26 retaining a note pad 24, a pair of foldable scissors 25 and a writing instrument 28. The housing 12 is divided into a pair of left and right compartments, with each compartment housing a plurality of hanging file folders provided with suitable index tabs 32 for alphabetically arranging a quantity of collected store coupons. Thus, an individual may utilize the scissors 25 to remove the coupons from newspapers and magazines and may then store the collected coupons in the file folders. The entire housing 12 may be transported to the grocery store and carried in the basket section of the shopping cart. This allows an individual to utilize the calculator 22 and note pad 20 while shopping.

Figure 3:
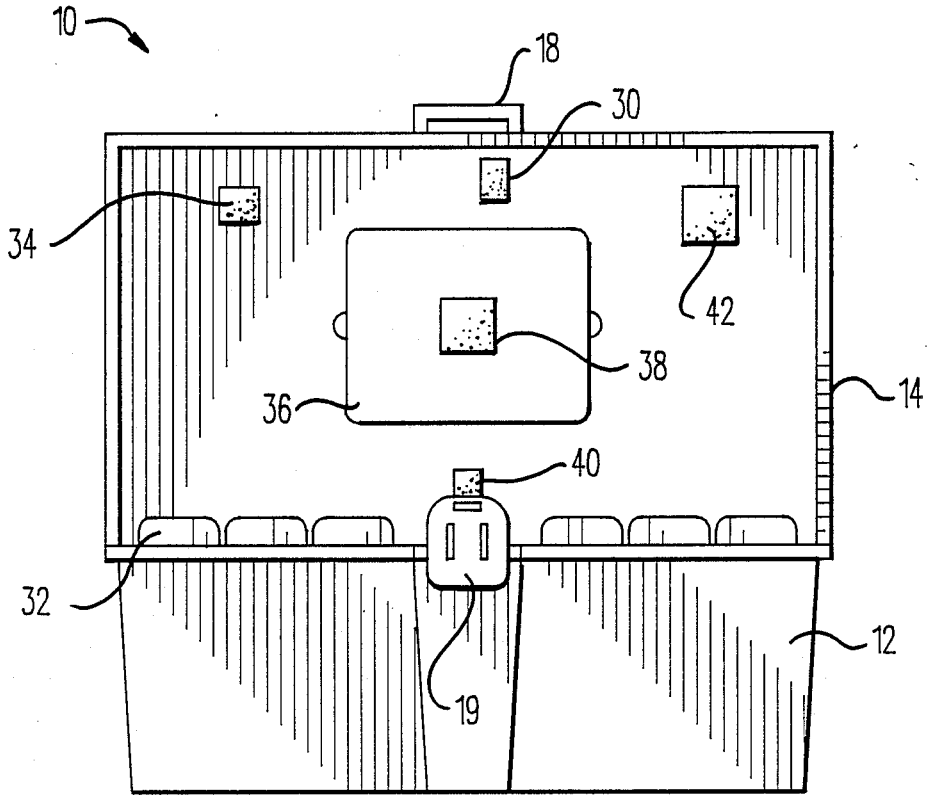
FIG. 3 is a side view of the coupon organizer of FIG. 1, with the hinged cover in an open position and with the various accessory items removed therefrom.

FIG. 3 illustrates the spaced hook and loop fasteners 30, 34, 38, 40 and 42 which are adhesively secured on the interior surface of the hinged cover 14. It should be noted that cooperating hook and loop fastening members are provided on the various accessory items. A central mounting plate section 36 is provided for storage of the calculator. The various cooperating hook and loop fasteners are preferably of the type sold under the trademark VELCRO.

Figure 4:
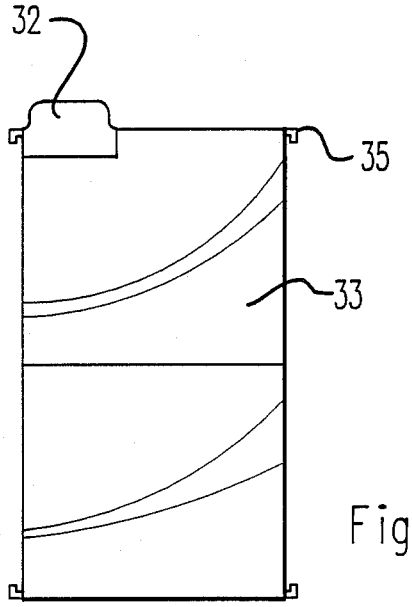
FIG. 4 is a detail view illustrating a reduced sized hanging folder utilized in the coupon organizer of the present invention.
Figure 5:
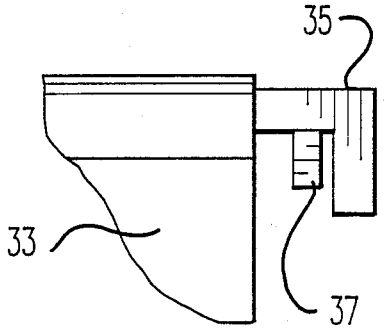
FIG. 5 is a detail view illustrating the mounting of the hanging folders within the coupon organizer housing.

FIG. 4 illustrates a reduced sized file folder 33 which includes an indexed tab 32. A conventional rigid hook 35 is provided on the folder 33 for supporting the hanging folder from transversely extending rigid bars 37 disposed within the interior of the housing 12, as illustrated in FIG. 5.

Figure 6:
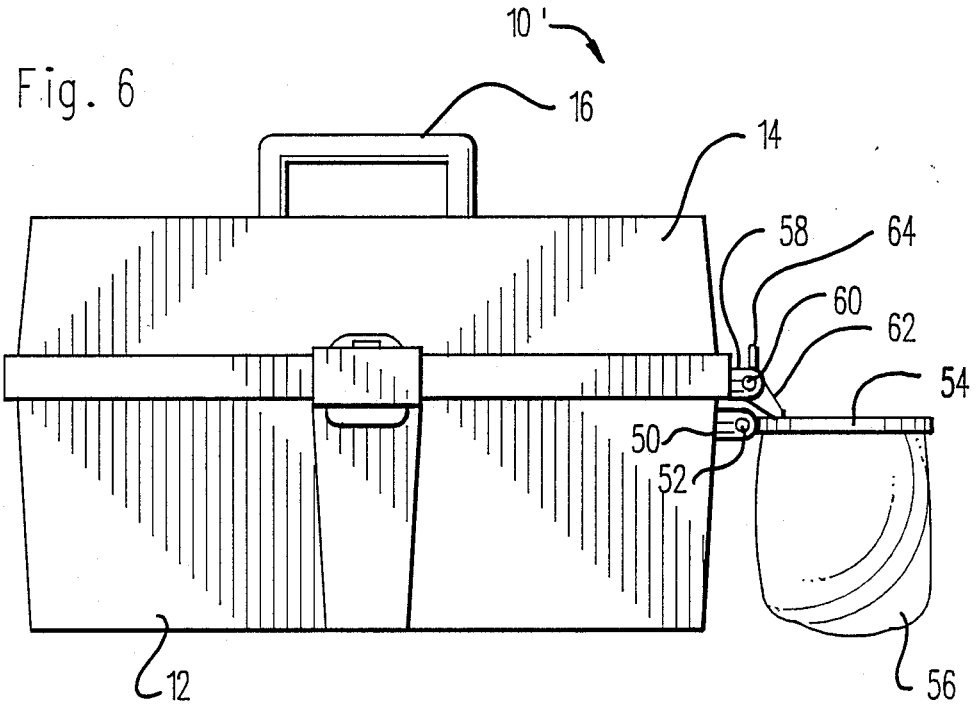
FIG. 6 is a side view illustrating a coupon organizer according to a second embodiment of the present invention and having a retractable trash receptacle illustrated in an open position.

FIG. 6 illustrates a slightly modified second embodiment 10' of the present invention, in which a collapsible trash receptacle 56 is suspended from a circular rigid loop 54. The supporting loop 54 is pivotally mounted on a pin 52 supported by a bracket 50 which is rigidly secured on the side wall of the housing 12. In the illustrated open position, the loop 54 is retained by a pivotal latch member 62 mounted on a pivot pin 60 secured to a bracket 58. By depressing the thumb latch 64, the loop 54 may be disengaged and pivoted to a retracted position, in which it extends generally parallel to the exterior side wall of the housing 12. A torsional coil spring (not shown) is received around the pivot pin 60 and biases the latch member 62 to the illustrated position in which it engages the supporting loop member 54 and thus retains the collapsible receptacle 56 in the open operative position.

Figure 7:
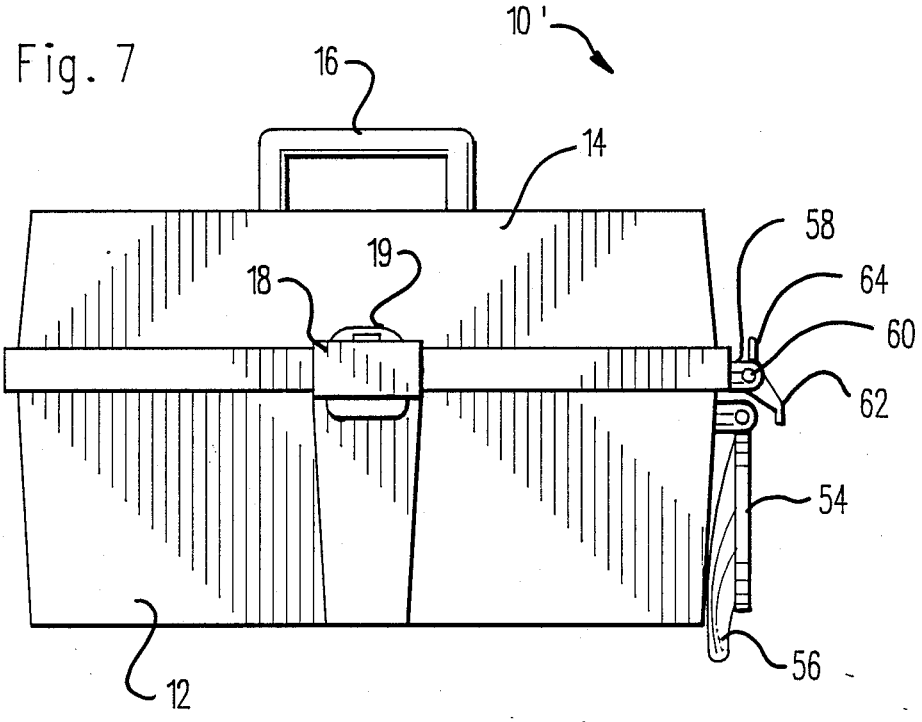
FIG. 7 is a side view of the coupon organizer of FIG. 6, with the retractable trash receptacle in a storage position.

FIG. 7 illustrates the receptacle 56 folded to an operative storage position. The receptacle 56 may be utilized to conveniently collect small bits of paper when an individual is collecting coupons. The internal construction of the second embodiment 10' is identical to that previously described with reference to the first embodiment 10 illustrated in FIGS. 1 through 5. In both the first 10 and second embodiments 10', the housing 12 and cover 14 are preferably formed from a rigid molded plastic material and the coupon organizer is approximately fifteen inches long, seven inches wide and five and one quarter inches deep. The interior hanging file folders 33, illustrated in FIG. 4, are formed of a correspondingly reduced dimension to enable storage within the interior of the housing 12.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A coupon organizer for organizing and transporting coupons and shopping accessory items, comprising:

a box-shaped rectangular housing having a hinged cover;

fastening means for securing said cover in a closed position;

a carrying handle mounted on an upper exterior surface of said cover;

a plurality of spaced hook and loop fastening members secured on an interior surface of said cover for removably securing various accessory items;

said housing divided into left and right compartments, with each of said left and right compartments housing a plurality of reduced sized hanging file folder for alphabetically organizing coupons; and a retractable waste receptacle pivotally mounted on an exterior side wall of said housing.

2. The coupon organizer of claim 1, further comprising a pivotal thumb latch on said housing for securing said retractable waste receptacle in an operative position.

3. The coupon organizer of claim 1, wherein said accessory items include folding scissors, note pads, a writing instrument and a calculator.

* * * * *